US005472105A

United States Patent [19]

Krishnakumar et al.

[11] Patent Number: 5,472,105

[45] Date of Patent: Dec. 5, 1995

[54] HOT-FILLABLE PLASTIC CONTAINER WITH END GRIP

[75] Inventors: Suppayan M. Krishnakumar, Nashua; Wayne N. Collette, Merrimack, both of N.H.

[73] Assignee: Continental PET Technologies, Inc., Florence, Ky.

[21] Appl. No.: 330,970

[22] Filed: Oct. 28, 1994

[51] Int. Cl.[6] ..... B65D 23/00

[52] U.S. Cl. ..... 215/384; 220/609; 220/675

[58] Field of Search ..... 214/1 C; 220/609, 220/675, 771

[56] References Cited

U.S. PATENT DOCUMENTS

| | | | |
|---|---|---|---|
| D. 192,536 | 4/1962 | Laudano | D58/5 |
| D. 193,216 | 7/1962 | Laudano | D58/5 |
| D. 193,312 | 7/1962 | Buckley | D58/25 |
| D. 196,990 | 11/1963 | Dubbs | D58/25 |
| D. 198,404 | 6/1964 | Busch | D58/5 |
| D. 202,002 | 8/1965 | Douglas | D58/7 |
| D. 213,421 | 3/1969 | Leary | D9/101 |
| D. 214,550 | 7/1969 | Plummer | D9/44 |
| D. 272,321 | 1/1984 | Kretz | D9/1 |
| D. 275,556 | 9/1984 | Thomson | D9/389 |
| D. 278,977 | 5/1985 | Franchi et al. | D9/383 |
| D. 279,167 | 6/1985 | Haney et al. | D9/378 |
| D. 281,577 | 12/1985 | Larson et al. | D9/367 |
| D. 305,980 | 12/1990 | Binder et al. | D9/372 |
| D. 315,869 | 4/1991 | Collette | D9/392 |
| D. 318,798 | 8/1991 | Biesecker | D9/378 |
| D. 323,983 | 2/1992 | Bastidos | D9/378 |
| D. 329,817 | 9/1992 | Best | D9/556 |
| D. 344,457 | 2/1994 | Prevot et al. | D9/537 |
| 4,804,097 | 2/1989 | Alberghini et al. | 215/1 C X |
| 4,863,046 | 9/1989 | Collette et al. | 215/1 |
| 4,890,752 | 1/1990 | Ota et al. | 215/1 |
| 4,993,565 | 2/1991 | Ota et al. | 215/1 |
| 5,141,120 | 8/1992 | Brown et al. | 215/1 |
| 5,141,121 | 8/1992 | Brown et al. | 215/100 |
| 5,178,289 | 1/1993 | Krishnakumar et al. | 215/1 |
| 5,199,587 | 4/1993 | Ota et al. | 215/1 |
| 5,255,889 | 10/1993 | Collette et al. | 249/102 |
| 5,279,433 | 1/1994 | Krishnakumar et al. | 215/1 C |
| 5,303,834 | 4/1994 | Krishnakumar et al. | 215/1 |
| 5,337,909 | 8/1994 | Vailliencourt | 215/1 |
| 5,392,937 | 2/1995 | Prevot et al. | 215/1 |

FOREIGN PATENT DOCUMENTS

0198587A2 10/1986 European Pat. Off. .

OTHER PUBLICATIONS

Mott's® Apple Juice Product Specification—Mar. 1992.
Color photos of a glass Mott's Apple Juice Bottle.
Color photos of a Tropicana Twister Light Bottle.
Color photos of a Poconos Springs Water Bottle.

*Primary Examiner*—Steven M. Pollard
*Attorney, Agent, or Firm*—Wolf, Greenfield & Sacks

[57] ABSTRACT

A hot-fillable plastic container having a panel section with vacuum panels and an end grip, which panel section resists ovalization and other deformation during filling, product cooling, and handling. The container has a substantially-cylindrical panel section, with a pair of vertically-elongated vacuum panels disposed on opposing sides of a vertical plane passing through a vertical centerline of the container. Front and rear label attachment areas are provided between the vacuum panels. A pair of vertical ribs are disposed on either side of each vacuum panel which act as hinge points to maximize movement of a concave recess in the vacuum panel; the vertical ribs also resist longitudinal bending. The concave recess is formed at an initial inwardly-bowed position with respect to the panel circumference, and is movable outwardly to a second position within the panel circumference upon increased pressure during filling, and movable inwardly to a third position to accommodate the vacuum which forms during product cooling.

15 Claims, 4 Drawing Sheets

HOT-FILLABLE PLASTIC CONTAINER WITH END GRIP

FIELD OF THE INVENTION

The present invention relates to a hot-fillable plastic container, and more particularly to a container having a panel section incorporating both vacuum panels and an end grip for ease of handling, and which panel section resists ovalization and other deformation.

BACKGROUND OF THE INVENTION

Hot-fillable plastic containers are designed for the packaging of liquids (e.g., juice) which must be placed in the container while hot to provide for adequate sterilization. During filling, the container is subjected to elevated temperatures on the order of 180°–185° F. (the product temperature) and positive internal pressures on the order of 2–5 psi (the filling line pressure). The container is then capped and as the product cools a negative internal pressure is formed in the sealed container.

Biaxially-oriented polyethylene terephthalate (PET) beverage bottles have been designed to receive a hot-fill product with a minimum of thermal shrinkage and distortion. Such a bottle is described in U.S. Pat. No. 4,863,046 entitled "Hot Fill Container," which issued Sep. 5, 1989 to Collette et al. The Collette et al. container is provided with a plurality of recessed vacuum panels in the middle panel section of the container, which reduce the magnitude of the vacuum generated in the filled and capped container to prevent any large uncontrolled shape distortion. As the product cools, the vacuum panels (all of them) deform and move inwardly in unison. A wrap-around label covers the vacuum panels and is supported by raised central wall portions in the vacuum panels, post areas between the vacuum panels, and horizontal glue land areas above and below the vacuum panels. Vertical recessed ribs may be provided in the post areas and within the vacuum panels to increase the longitudinal stiffness of the panel section.

The design of the vacuum panels may vary; other designs are illustrated in: 1) Design U.S. Pat. No. 315,869, "Container Body For Liquids Or The Like," Apr. 2, 1991 to Collette; 2) U.S. Pat. No. 5,255,889, "Modular Mold," Oct. 26, 1993 to Collette et al.; 3) U.S. Pat. No. 5,178,289, "Panel Design For A Hot-Fillable Container," Jan. 12, 1993 to Krishnakumar et al.; and 4) U.S. Pat. No. 5,303,834, "Squeezable Container Resistant To Denting," Apr. 19, 1994 to Krishnakumar et al., each of which is hereby incorporated by reference in its entirety.

There are numerous plastic containers with end grips for cold-fill applications. For example, three patents recently issued to Ota et al., U.S. Pat. Nos. 4,890,752, 4,993,565, and 5,199,587, all directed to blow-molded PET containers with an end grip. The Ota containers are designed to provide sufficient mechanical strength to resist crushing during drop impact and/or the increased pressure caused by gripping of the container. However, there is no mention of the use of these containers for hot-fill products, and the containers do not include vacuum panels.

One prior art attempt to design a hot-fill container with an end grip is described in U.S. Pat. No. 5,141,121 to Brown et al.; however, the Brown container is not known to have been commercialized. Brown describes a grip within a vacuum collapse panel, but the design of the Brown grip/panel is believed to be deficient. More specifically, the Brown grip/panel is formed (blow-molded) in an outwardly bulged configuration, and is intended to collapse inwardly to alleviate the drop in pressure during cooling of the product (see Brown FIG. 3). However, it is believed that the negative pressure generated during product cooling is not sufficiently strong to pull in the outwardly bulged panel section. Thus, Brown does not solve the problem of providing a hot-fillable container with an end grip.

Another apparent attempt to provide a hot-fillable container with an end grip is shown in Design U.S. Pat. No. 334,457 to Prevot et al. The Prevot container has recently been commercialized (Welch's™ grape juice). The container is molded with a cylindrical panel shape (see Prevot FIG. 7), but during hot-filling, sealing and product cooling apparently undergoes a deliberate or unintentional transformation to become an ovalized or egg-shaped container. The commercial container is highly ovalized. The present inventors believe this ovalization is due to the absence of flexible vacuum panel sections which can move inwardly to lower the internal vacuum. The ovalization is undesirable in terms of the container's stackability and packability in a shipping carton and on the retail shelf. Thus, the ovalized Prevot container fails to provide a satisfactory solution.

Thus, there is a need for a hot-fillable plastic container having a panel section with readily deformable vacuum panels and an end grip, and which panel section resists ovalization and other forms of deformation during hot-filling, cooling, drop impact, and handling.

SUMMARY OF THE INVENTION

The present invention is a hot-fillable plastic container, having an end grip, which resists ovalization and other forms of permanent deformation. More specifically, the container has a substantially cylindrical panel section with a pair of vertically elongated vacuum panels disposed on opposite sides of a vertical plane passing through a vertical centerline of the container. Front and rear label attachment areas are provided between the pair of vacuum panels. A pair of vertical ribs adjacent each side of the vacuum panel act as hinge points to provide increased flexibility of the vacuum panel. A central bottom recess in each vacuum panel is surrounded by a concave intermediate recess of relatively large area. The intermediate recess flexes easily, via the previously described hinge points, to maximize vacuum panel movement. The bottom recess forms a gripping area for the thumb and fingers of one hand, and preferably includes a transverse (horizontal) rib across the bottom recess to prevent popping out of the vacuum panel during filling.

The bottom and intermediate recesses are formed (i.e., in the blow mold) at an initial inwardly-bowed position, with respect to the circumference of the panel section. The recesses then move outwardly to a second inwardly-bowed position, still within the circumference of the panel section, during the increased pressure caused by product filling at an elevated temperature. The recesses next move back inwardly to a third inwardly-bowed position following sealing and product cooling, to alleviate the vacuum. This successive movement of the panel recesses avoids permanent and uncontrolled deformation of the panel section.

Preferably, a horizontally disposed hoop rib is provided around the circumference of the panel section to further resist ovalization. Additional horizontal ribs may be provided in the front and rear label attachment areas to increase the resistance of the container to deformation caused by increased pressure when gripping the container.

These and other advantages of the present invention will be more particularly described in regard to the following description and drawings of select embodiments.

DETAILED DESCRIPTION

Figure 1:
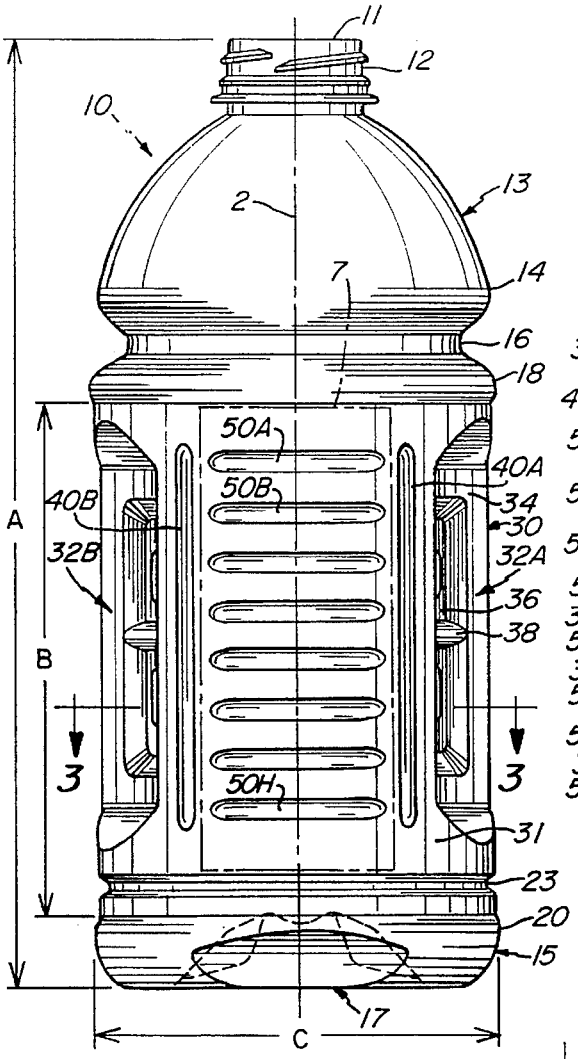
FIG. 1 is a rear elevational view of a first embodiment of the hot-fillable container of this invention, having two vertically-disposed vacuum panels, and showing in phantom a partial label over a rear label attachment area.
Figure 2:
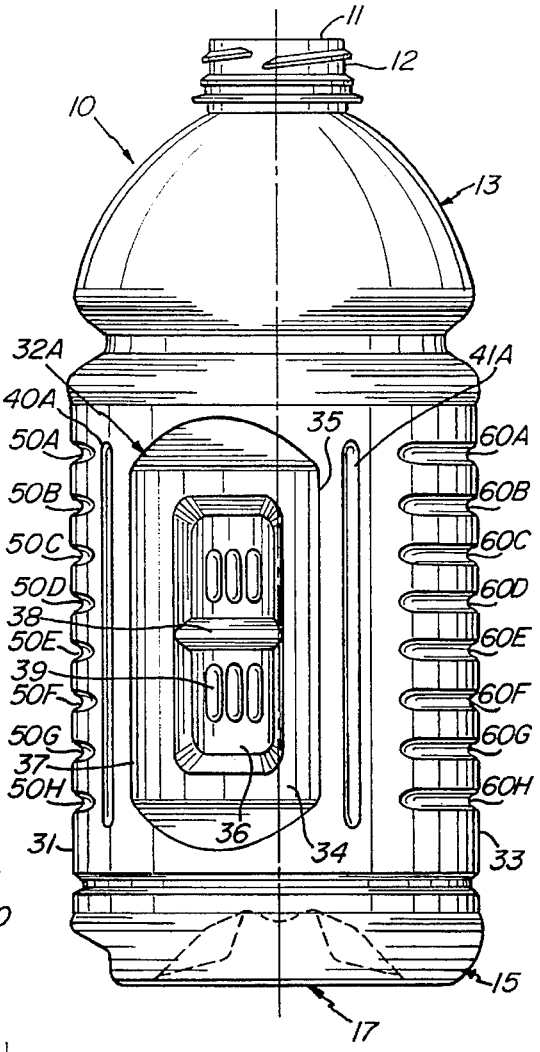
FIG. 2 is a side elevational view of the container of FIG. 1, showing one vacuum panel and an adjacent pair of vertical ribs which act as hinge points to maximize vacuum panel movement.

FIG. 1 shows a particular embodiment of the present invention—a 64-ounce polyethylene terephthalate (PET) beverage bottle. This bottle has an overall height A of about 265 mm, a panel section height B of about 140 mm, and a diameter C of about 115 mm. The thickness of the container at the panel section B is on the order of 0.5 mm.

Figure 4:
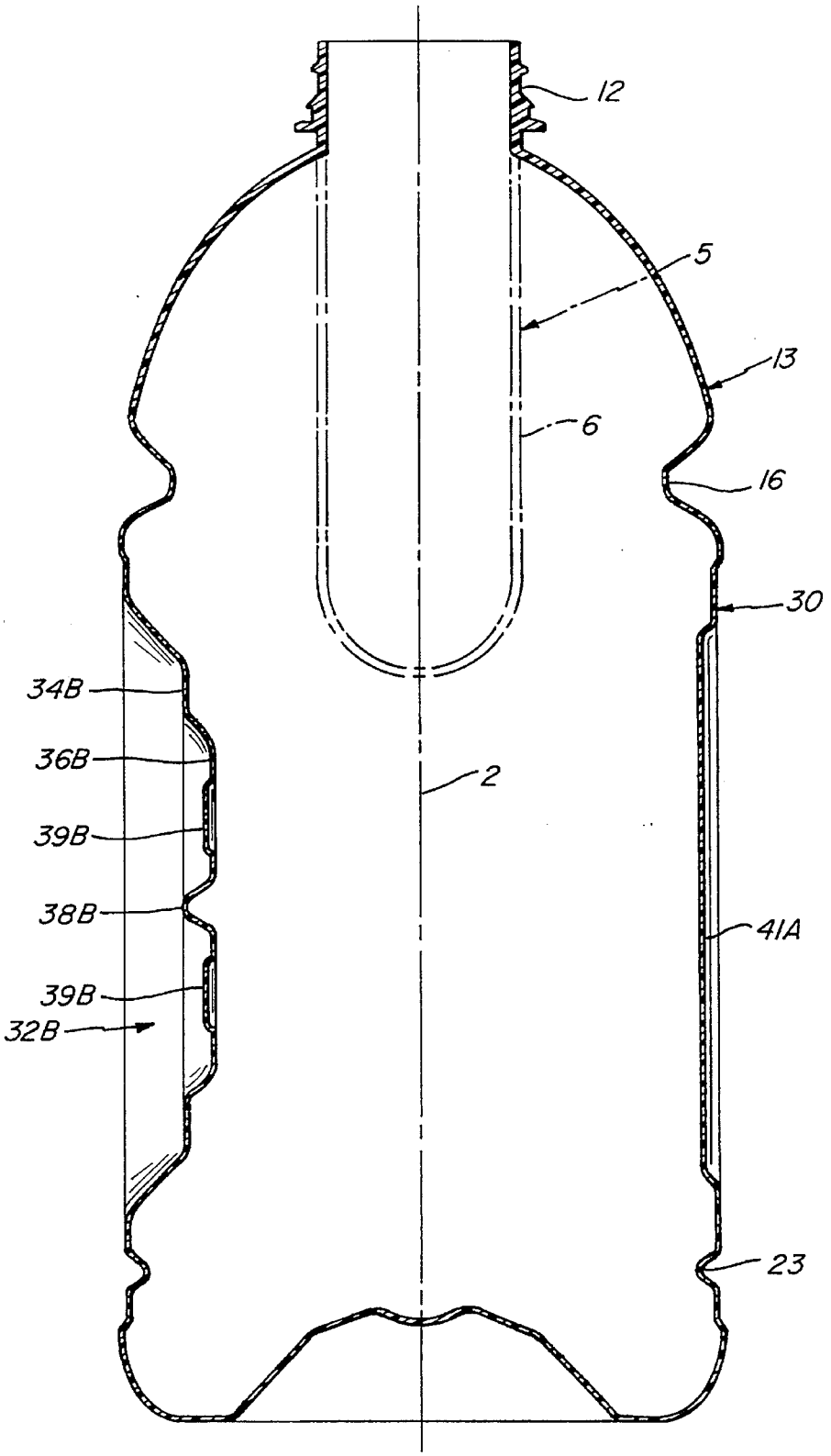
FIG. 4 is a longitudinal sectional view of the container of FIG. 1 taken along line 4—4 of FIG. 3, showing a vertical rib on the right side of the container and a vacuum panel on the left side of the container; a preform from which the container is blow-molded is shown in phantom lines.

The bottle 10 is blow molded from an injection molded preform 5, shown in phantom in FIG. 4, having an upper threaded neck finish 12 and a lower tube portion 6. During blowing, the preform is expanded and assumes the shape of an interior molding surface (not shown) to form a substantially transparent, biaxially-oriented bottle. The neck finish 12 is not expanded and remains the thread finish of the bottle with an open mouth 11 for receiving a screw-on cap (not shown). A lower preform tube portion 6 is expanded to form: (a) a shoulder section 13 increasing generally in diameter from the neck finish to a substantially cylindrical panel section 30; (b) the panel section 30 including a pair of right and left vertically-elongated vacuum panels 32A and 32B, and front and rear label attachment areas 33 and 31, respectively; and (c) a base 15.

A lower shoulder portion includes a radially-recessed hoop rib 16 between enlarged diameter portions 14 and 18. The hoop rib 16 helps prevent ovalization. The enlarged portion 18 forms an upper bumper, just above the panel section 30. The base 15 includes an enlarged diameter lower bumper 20. The panel section 30 of height B extends between the upper and lower bumpers 18 and 20 respectively. The upper and lower bumpers are of greater diameter than the panel section in order to protect the attached rear label 7 during shipment and storage. A second front label (not shown) may be applied over the front label attachment area 33. The base has a recessed closed bottom end 17 and may include additional deformable elements that move inwardly to reduce the negative pressure generated during product cooling.

Figure 3:
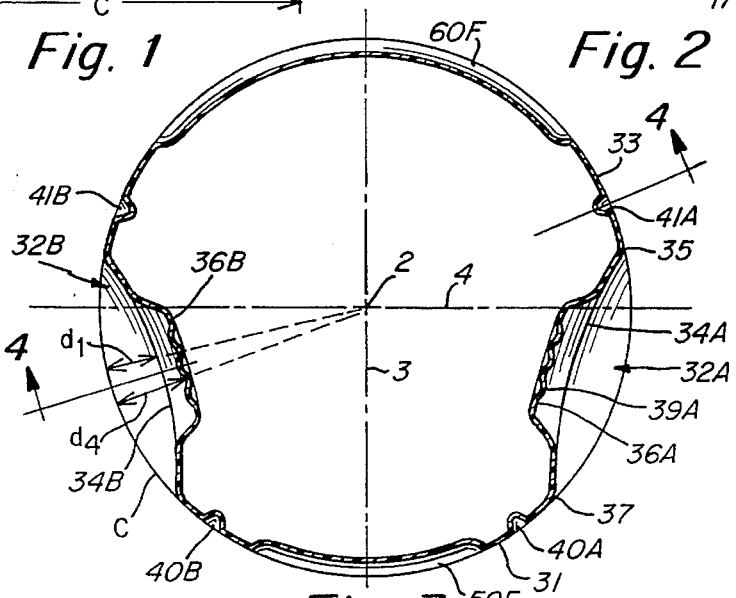
FIG. 3 is a cross-sectional view of the panel section of the container of FIG. 1 taken along section line 3—3, showing the front and rear label attachment areas between the opposing pair of vacuum panels.

The substantially cylindrical panel section 30, shown in horizontal cross-section in FIG. 3, includes two recessed vacuum panels 32A and 32B symmetrically disposed about a first vertical center plane 3 passing through a vertical centerline 2 of the container. The vacuum panels are disposed substantially to one side of a second orthogonal vertical plane 4, also passing through the vertical centerline 2. Each vacuum panel 32A, 32B is disposed between front label attachment area 33 and rear label attachment area 31, the later of which form part of the substantially cylindrical circumference of the panel section. Of particular importance in this invention, a pair of vertical ribs 40, 41 are disposed adjacent the vertical side edges 35, 37 of each vacuum panel. Each vacuum panel includes a centered lowermost bottom wall 36, which is disposed radially-inwardly from the panel circumference C. The bottom recess 36 is at a distance $d_4$ radially inward from circumference C and is centered with respect to the surrounding intermediate recess 34, which is at a distance $d_1$ which is less than distance $d_4$. The relatively large area intermediate recess 34 provides an enlarged area for enhanced flexibility of the vacuum panel. The concave recess 34 moves readily via hinge points provided by the vertical ribs 40 and 41. To maximize movement, the recess 34 is preferably at least on the order of 50% of the vacuum panel area, and more preferably on the order of 65 to 75% of the vacuum panel area. Each concave recess 34 preferably has an angular extent on the order of 50° to 110° of the panel circumference; the angular extent is defined between the side edges 35, 37 where the recess 34 meets the label areas 33, 31 respectively. The longitudinal ribs 40, 41 are preferably within on the order of 7 to 12° from the side edges 35, 37 of the vacuum panel, and more preferably within on the order of 10°, again to maximize movement of the concave recess 34. The vertical ribs 40, 41 also provide resistance to longitudinal bending of the panel section.

The container is designed to be gripped by one hand along the rear label attachment area 31, by placing a thumb in the central recess 36 of one of the vacuum panels (e.g., 32A), and the other four fingers in the central recess of the opposing vacuum panel (e.g., 32B). Three outwardly-protruding vertical finger grips 39 are provided on the bottom recess 36 of the grip, above and below a transverse rib 38, for more secure gripping of the container. The transverse horizontal rib 38 extends across the bottom recess to prevent the vacuum panel from popping out, as described further hereinafter.

Figure 5:
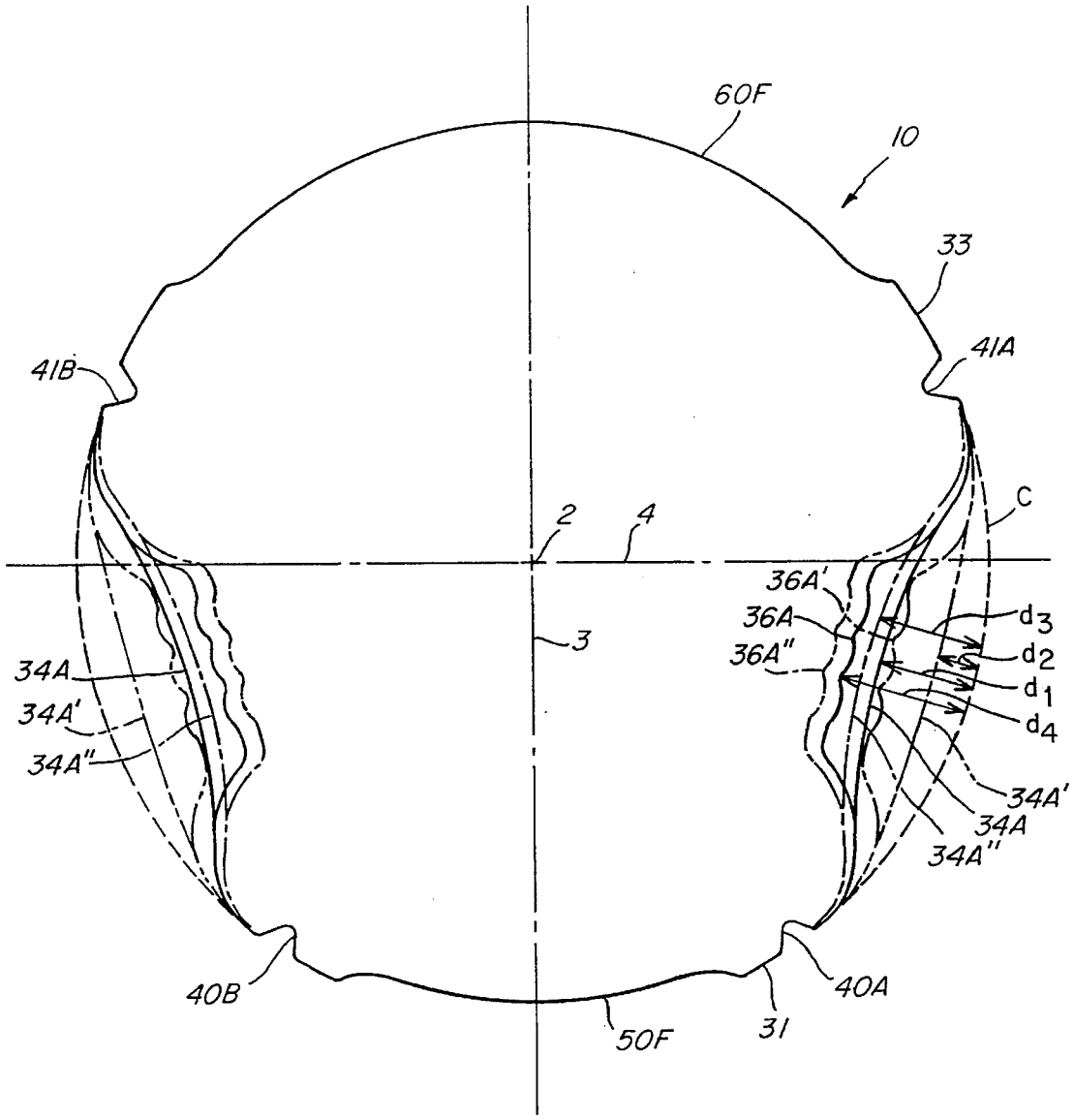
FIG. 5 is an enlarged schematic view of FIG. 3 showing the various positions of the vacuum panel as manufactured (solid lines), during filling (phantom lines), and after cooling (dashed lines).

FIG. 3 shows the cross-section of the container as molded. FIG. 5 illustrates the movement of the various vacuum panel portions during product filling and cooling. More specifically, FIG. 5 shows on the right in solid lines the initial position (as molded) of the intermediate recess 34A, which assumes an inwardly-bowed position at a first distance $d_1$ from the circumference C of the panel section. During filling of the hot product into the container there is an increase in pressure, and the intermediate recess 34A moves radially outwardly to a second position shown in phantom lines 34A', which is still within the panel circumference. It is undesirable to have the vacuum panel move outwardly beyond the circumference of the panel section during filling because this would be a permanent deformation—the panel would then not move inwardly to accommodate the vacuum during product cooling. Thus, in the second position the intermediate recess is at a second distance $d_2$ from the panel circumference which is less than the first distance $d_1$, but still radially inwardly of the panel circumference. Finally, during product cooling and formation of a vacuum, the intermediate recess moves radially inwardly to a third innermost position 34A" shown in dashed lines, which is disposed at a third distance $d_3$ from the panel circumference which is greater than the first distance $d_1$.

As shown in FIG. 5, the vertical ribs 40A, 41A act as hinge points to maximize movement of the vacuum panel. These ribs are of relatively small radius, for example having a radius of about 1.5 mm and being disposed about 8° from the edge of the vacuum panel.

FIG. 5 similarly shows the corresponding radial inward and outward movement of the bottom recess 36A (as molded), 36A' (during filling), 36A" (after cooling). The panel wall thickness and recess dimensions are adapted to allow such movement under the known filling pressures and cooling pressures. In a preferred embodiment for non-pressurized beverages, the panel section has a wall thickness of on the order of 0.012 to 0.025 inches, $d_1$ is on the order of 0.35 to 0.65 inches, and $d_4$ is on the order of 0.50 to 0.90 inches.

The container 10 further includes a first set of horizontal ribs 50A–50H in the rear label attachment area 31, and a second set of horizontal ribs 60A–60H in the front label attachment area 33. These ribs strengthen the panel section to resist ovalization and permanent deformation when the container is gripped by the user and/or during shipment and handling. A continuous horizontal or radial rib 23 is provided below the vacuum panel to provide further structural rigidity and resistance to ovalization.

Figure 6:
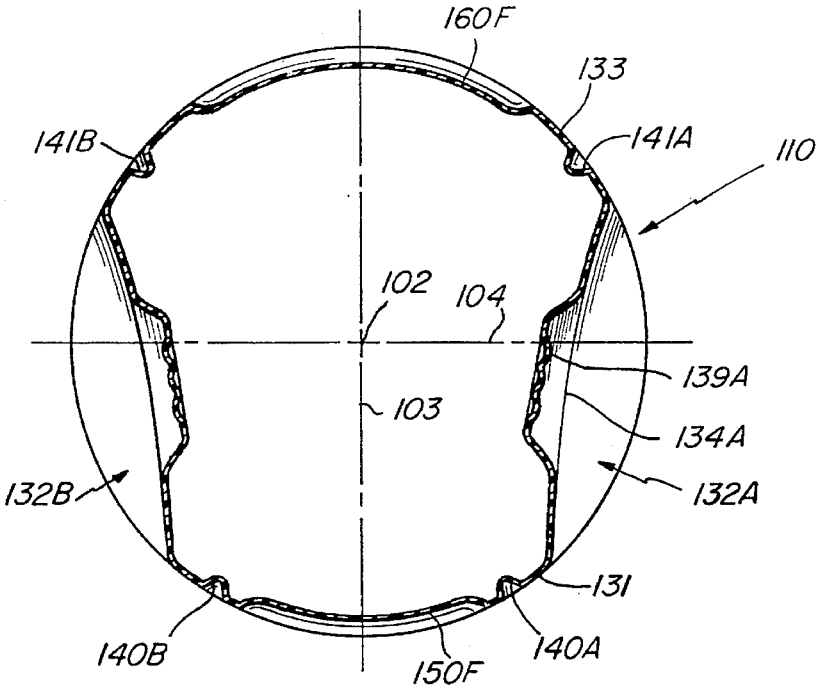
FIG. 6 is a cross-sectional view similar to FIG. 3 but of an alternative embodiment in which the vacuum panels occupy a larger angular extent and are more nearly centered about a second plane passing through the centerline of the container.

FIG. 6 shows in cross section, similar to FIG. 3, an alternative container 110. Unless otherwise indicated, container 110 is identical in all respects to container 10; the corresponding elements have been numbered by adding "100" to the figure number from FIG. 1. The difference in FIG. 6 is that the vacuum panels are larger and more nearly centralized with respect to the two vertical cross planes 103 and 104. The vacuum panels in FIG. 6 occupy a larger angular extent of the panel circumference, while the front and rear label attachment areas 133, 131 occupy substantially less angular extent. This design provides more flexible vacuum panels, and may be particularly useful with larger diameter containers, i.e., 4.0 inches and larger in diameter.

Figure 7:
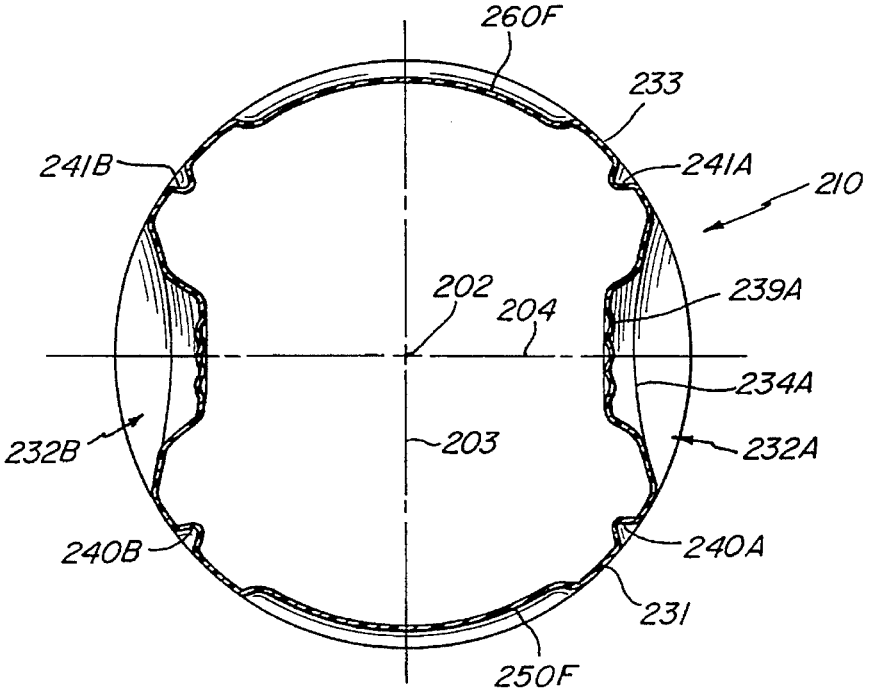
FIG. 7 is a cross-sectional view similar to FIG. 3 of a further alternative embodiment having a pair of symmetrically disposed vacuum panels, wherein the front and rear label attachment areas are substantially equal.

FIG. 7 is a cross-sectional view of a further alternative container 210 similar in all respects to the container 10 of FIG. 1, and where corresponding elements have been given a "200" number series designation. However, in container 210, the vacuum panels 232A, 232B are now symmetrically disposed both with respect to first vertical plane 203 and second transverse vertical plane 204. The front and rear label attachment areas 233 and 231 now occupy substantially similar angular extents. In terms of performance, this design will provide more symmetrical vacuum panel movement, and is particularly useful for smaller diameter containers, i.e., 3.5 inches and smaller in diameter.

The container may be made of any of the known polymer resins which provide good strength at the elevated fill temperature, such as polyesters, polyolefins, polycarbonates, nitriles, and copolymers of the above, as well as other high temperature polymers.

Phthalic acid polyesters based on terephthalic or isophthalic acid are commercially available and convenient. The hydroxy compounds are typically ethylene glycol and 1,4-di-(hydroxymethyl)cyclohexane. The intrinsic viscosity for phthalate polyesters are typically in the range of 0.6 to 1.2, and more particularly 0.7 to 1.0 (for O-chlorolphenol solvent). 0.6 corresponds approximately to a viscosity average molecular weight of 59,000, and 1.2 to a viscosity average molecular weight of 112,000. In general, the phthalate polyester may include polymer linkages, side chains, and end groups not related to the formal precursors of a simple phthalate polyester. Conveniently, at least 90 mole percent will be terephthalic acid and at least 45 mole percent an aliphatic glycol or glycols, especially ethylene glycol.

Another useful polymer with physical properties similar to PET is polyethylene naphthalate (PEN). PEN provides a 3–5X improvement in oxygen barrier property (compared to PET), at some additional expense.

The container may be either a monolayer, or a multilayer construction, including layers of an oxygen barrier material such as ethylene vinyl alcohol or polyvinyledene chloride, and may include a layer of reprocessed scrap material, such as post-consumer or recycled PET.

The container may have a closure other than a screw threaded cap, such as a slidable nozzle as used on sports bottles.

Although certain preferred embodiments of the invention have been specifically illustrated and described herein, it is to be understood that variations may be made without departing from the spirit and scope of the invention as defined by the appended claims. For example, the container sizes and shapes may be varied as well as the vacuum panel design. Furthermore, the containers may be other than bottles and they may be made from other thermoplastic resins or materials. Thus, all variations are to be considered as part of the invention as defined by the following claims.

We claim:

1. A hot-fillable plastic container with end grip comprising:

a plastic container body including an open top end, closed bottom end, and sidewall having a panel section with a substantially cylindrical panel circumference:

the panel section including:

a pair of vertically-elongated vacuum panels symmetrically disposed on opposing sides of a vertical plane passing through a vertical centerline of the container, each vacuum panel comprising a central bottom recess for gripping the container in one hand and an outwardly concave intermediate recess surrounding the bottom recess, the intermediate recess being adapted to move radially inward to alleviate negative pressure generated in the container;

front and rear label attachment areas between the pair of vacuum panels; and a pair of vertical ribs adjacent either side of each vacuum panel which act as hinge points to facilitate movement of the intermediate recess;

the intermediate recess having an initial radial inwardly-bowed position with respect to the panel circumference prior to product filling, the intermediate recess being movable outwardly to a second position within the panel circumference upon increased pressure during filling of the container body with a product at an elevated temperature, and the intermediate recess being movable inwardly to a third position under vacuum pressure following sealing of the container and cooling of the product.

2. The container of claim 1, further comprising at least one radial hoop rib disposed in the panel section above or below the vacuum panels.

3. The container of claim 1, further comprising horizontal ribs in one or more of the front and rear label attachment areas.

4. The container of claim 1, further comprising a horizontal rib extending across at least a portion of the vacuum panel.

5. The container of claim 4, wherein the horizontal rib extends across the bottom recess.

6. The container of claim 1, wherein the plastic is selected from the group consisting of polyesters, polyolefins, polycarbonates, polyethylene naphthalates, nitriles, and copolymers thereof.

7. The container of claim 6, wherein the container is a substantially transparent, biaxially-oriented, blow-molded polyester container.

8. The container of claim 7, wherein the polyester is substantially polyethylene terephthalate.

9. The container of claim 1, wherein the panel section has a wall thickness on the order of 0.012 to 0.025 inches.

10. The container of claim 9, wherein the intermediate recess comprises at least on the order of 50% of the vacuum panel area.

11. The container of claim 10, wherein the intermediate recess comprises on the order of 65 to 75% of the vacuum panel area.

12. The container of claim 11, wherein the intermediate recess occupies an angular extent on the order of 50 to 110° of the panel circumference.

13. The container of claim 12, wherein the longitudinal ribs are within on the order of 7° to 12° from the longitudinal side edges of the vacuum panel.

14. The container of claim 13, wherein the distance $d_1$ from the panel circumference to the intermediate recess in the initial position is on the order of 0.35 to 0.65 inches.

15. The container of claim 14, wherein the distance $d_4$ from the panel circumference to the bottom recess in the initial position is on the order of 0.50 to 0.90 inches.

* * * * *